US008456375B2

(12) United States Patent
Leisten

(10) Patent No.: US 8,456,375 B2
(45) Date of Patent: Jun. 4, 2013

(54) MULTIFILAR ANTENNA

(75) Inventor: Oliver Paul Leisten, Northamptonshire (GB)

(73) Assignee: Sarantel Limited, Wellingborough (GB)

( * ) Notice: Subject to any disclaimer, the term of this patent is extended or adjusted under 35 U.S.C. 154(b) by 448 days.

(21) Appl. No.: 12/829,774

(22) Filed: Jul. 2, 2010

(65) Prior Publication Data

US 2011/0001680 A1 Jan. 6, 2011

Related U.S. Application Data

(63) Continuation-in-part of application No. 12/720,995, filed on Mar. 10, 2010.

(60) Provisional application No. 61/175,695, filed on May 5, 2009, provisional application No. 61/175,694, filed on May 5, 2009, provisional application No. 61/224,731, filed on Jul. 10, 2009.

(30) Foreign Application Priority Data

Jul. 3, 2009 (GB) ..... 0911635.1

(51) Int. Cl.
*H01Q 1/50* (2006.01)
*H01Q 1/36* (2006.01)

(52) U.S. Cl.
USPC ..... 343/859; 343/895

(58) Field of Classification Search
USPC ..... 343/895, 702, 859, 850, 853
See application file for complete search history.

(56) References Cited

U.S. PATENT DOCUMENTS 5,828,348 A * 10/1998 Tassoudji et al. ..... 343/895
5,986,616 A 11/1999 Edvardsson
5,986,620 A 11/1999 Filipovic
5,990,847 A 11/1999 Filipovic et al.
6,181,295 B1 1/2001 Sharaiha et al.

(Continued)

FOREIGN PATENT DOCUMENTS

EP 1 039 575 A1 9/2000
EP 1 076 378 A1 2/2001

(Continued)

OTHER PUBLICATIONS

Search Report for Application No. GB 0904308.4 dated Jun. 30, 2009.

(Continued)

*Primary Examiner* — Huedung Mancuso
(74) *Attorney, Agent, or Firm* — Alston & Bird LLP

(57) ABSTRACT

In a dielectrically-loaded multifilar helical antenna, a conductive phasing ring is arranged between and couples together feed nodes and the helical radiating elements. The phasing ring includes an annular conductive path having an electrical length equivalent to a full wavelength at the operating frequency so as to be resonant at that frequency. The helical elements are coupled to the outer periphery of the phasing ring at respective spaced apart coupling locations. The helical elements may include open-circuit or closed-circuit elongate conductive tracks, or a combination of both. In the case of the helical elements being closed-circuit tracks, these tracks are interconnected by a second resonant ring, which is resonant at the same frequency as or a different frequency from the first resonant ring. The invention is applicable to both end-fire and back-fire helical antennas.

28 Claims, 9 Drawing Sheets

U.S. PATENT DOCUMENTS

| | | | | |
|---|---|---|---|---|
| 6,181,297 | B1 | 1/2001 | Leisten | |
| 6,229,499 | B1 | 5/2001 | Licul et al. | |
| 6,300,917 | B1 * | 10/2001 | Leisten et al. | 343/895 |
| 6,421,028 | B1 | 7/2002 | Ohgren et al. | |
| 6,608,604 | B1 * | 8/2003 | Sharaiha et al. | 343/895 |
| 7,151,505 | B2 | 12/2006 | Jostell et al. | |
| 7,372,427 | B2 * | 5/2008 | Leisten | 343/895 |
| 7,515,113 | B2 | 4/2009 | Petros | |
| 7,817,101 | B2 | 10/2010 | Cowles | |
| 8,089,421 | B2 * | 1/2012 | Leisten et al. | 343/895 |
| 2002/0000949 | A1 | 1/2002 | Nishino et al. | |
| 2006/0022891 | A1 | 2/2006 | O'Neill et al. | |
| 2006/0082517 | A1 | 4/2006 | Chung et al. | |
| 2007/0063919 | A1 | 3/2007 | Leisten et al. | |
| 2008/0174501 | A1 | 7/2008 | Licul et al. | |
| 2008/0218430 | A1 | 9/2008 | Leisten | |
| 2008/0316138 | A1 | 12/2008 | Hozouri | |

FOREIGN PATENT DOCUMENTS

| | | | |
|---|---|---|---|
| EP | 1 147 571 | B1 | 10/2001 |
| GB | 2 292 638 | A | 2/1996 |
| GB | 2 310 543 | A | 8/1997 |
| GB | 2 311 675 | A | 10/1997 |
| GB | 2 367 429 | B | 8/2003 |
| GB | 2 399 948 | B | 9/2004 |
| GB | 2 420 230 | A | 5/2006 |
| GB | 2 424 521 | A | 9/2006 |
| GB | 2 437 998 | A | 11/2007 |
| GB | 2 444 388 | A1 | 6/2008 |
| GB | 2 444 750 | A | 6/2008 |
| GB | 2 445 478 | A | 7/2008 |
| JP | 2001-127527 | A | 5/2001 |
| KR | 20080027052 | A | 3/2008 |
| WO | WO 96/18220 | | 6/1996 |
| WO | WO 99/33146 | A1 | 7/1999 |
| WO | WO 99/34481 | | 7/1999 |
| WO | WO 2006/045769 | A1 | 5/2006 |
| WO | WO 2006/136809 | A1 | 12/2006 |
| WO | WO 2008/111799 | A1 | 9/2008 |

OTHER PUBLICATIONS

Search Report for Application No. GB 0904307.6 dated Apr. 30, 2009.

Search Report for International Application No. PCT/GB2010/000415 mailed Jun. 23, 2010.

Search Report for United Kingdom Application No. GB1003911.3 dated Jun. 6, 2010.

Search Report and Written Opinion for International Application No. PCT/GB2010/001279, completed Sep. 28, 2010; 8 pages.

Search Report dated Oct. 5, 2009, for GB Application No. 0911635.1.

Examination Report for Application No. GB 1011226.6 dated Sep. 27, 2012.

* cited by examiner

MULTIFILAR ANTENNA

CROSS-REFERENCE TO RELATED APPLICATIONS

This application is a continuation-in-part of U.S. patent application Ser. No. 12/720,995 filed Mar. 10, 2010, currently pending, which in turn claims priority from U.S. Provisional Patent Application Nos. 61/175,695 and 61/175,694 both filed May 5, 2009. The present application also claims priority from U.S. Provisional Patent Application No. 61/224,731 filed Jul. 10, 2009, now abandoned. The entirety of each of these applications is incorporated by reference herein.

FIELD OF THE INVENTION

This invention relates to a multifilar antenna for circularly polarised radiation having an operating frequency in excess of 200 MHz, and primarily but not exclusively to dielectrically loaded multifilar antennas.

BACKGROUND OF THE INVENTION

Dielectrically-loaded multifilar antennas are disclosed in Published International Patent Application No. WO2006/136809, British Patent Publication No. 2442998A, European Patent Publication No. EP1147571A, British Patent Publications Nos. 2420230A, 2444388A, 2437998A and 2445478A. The entire disclosure of these patent publications is incorporated in the present application by reference. Such antennas are intended mainly for receiving circularly polarised signals from a Global Navigation Satellite System (GNSS), e.g. from satellites of the Global Positioning System (GPS) satellite constellation, for position fixing and navigation purposes. Other satellite-based services for which such antennas are useful include satellite telephone services such as the L-band Inmarsat service 1626.5-1675.0 MHz and 1518.0-1559.0 MHz, the TerreStar (registered trade mark) S-band service, the ICO Global Communications S-band service and the SkyTerra service. The S-band services have allocated frequency bands in the range of from 2000 MHz to 2200 MHz.

SUMMARY OF THE INVENTION

According to a first aspect of the present invention, there is provided a dielectrically loaded multifilar antenna for circularly polarised radiation having an operating frequency in excess of 200 MHz, wherein the antenna comprises an electrically insulative substrate formed of a solid dielectric material having a relative dielectric constant of at least 5, a pair of feed nodes, at least four elongate conductive radiation elements located on the substrate, and, arranged between and coupling together the feed nodes and the radiating elements, a phasing ring formed by a closed loop which is resonant at the operating frequency, the radiating elements being coupled to the phasing ring at respective spaced apart coupling locations. In this way the radiating elements are fed via the phasing ring which has the effect of feeding the radiating elements in a phase progression, yielding a circular polarisation characteristic. Typically the antenna has a central axis and a phasing comprising a conductive track located on the substrate and encircling the axis. The phasing ring may be a continuous track or a broken one. In the latter case, the ring includes at least a pair of lumped reactances, typically capacitances, in series with conductive track portions, these portions together with the reactances forming the above-mentioned closed loop.

Preferably, the phasing ring is circular, although other configurations are possible, including a square or other polygon, and a meandered circle (i.e. following a path which deviates in a repetitive way to the inside and outside of a circle).

In a particularly preferred antenna in accordance with the invention, the substrate is a cylindrical body having a cylindrical side surface portion and proximal and distal end surface portions. The phasing ring is preferably located on the proximal end surface portion so that the antenna is an "end-fire" antenna, i.e. producing a circularly polarised radiation pattern with a maximum in the distal direction. The feed nodes are most easily centrally located, either on or the substrate itself or as part of a connection assembly associated with the end surface bearing the phasing ring. In the preferred antenna, the feed nodes are coupled to the phasing ring at substantially diametrically opposed positions by respective feed connection conductors extending radially with respect to the cylindrical axis.

It is preferred that the phasing ring is dielectrically loaded by the substrate and has an electrical length of a single wavelength (i.e. 360°). In the preferred antenna, the radiating elements have first ends coupled to the phasing ring and second ends spaced from the phasing ring, the second ends being open-circuit. In this case, the electrical length of each of the radiating elements is preferably a quarter wavelength or an odd integer multiple thereof at the operating frequency.

In an alternative preferred embodiment, the antenna has a second conductive ring, also resonant at the operating frequency, linking the second ends of the radiating elements which, in this instance, each have an electrical length of a half wavelength or an integer multiple thereof.

It is also possible to construct a "backfire" antenna in accordance with the invention, the phasing ring typically being plated on a distal end surface portion of the core. A second conductive ring, resonant at a different frequency, may, in this case, surround the core on its cylindrical side surface. Such a ring may be formed as the annular edge of a conductive sleeve extending around a proximal end portion of the core, the sleeve forming part of an integral balun, as described in the prior patent publications referred to above. Some of the radiating elements may be open-circuit, extending from the distal phasing ring to open-circuit ends spaced from the second conductive ring, while the other radiating elements are closed-circuit, extending from the distal phasing ring to the second ring. In this way the antenna can be made to resonate at two separate operating frequencies, each resonance being for circularly polarised radiation.

According to a second aspect of the invention, a dielectrically-loaded multifilar antenna for circularly polarised radiation having an operating frequency in excess of 200 MHz comprises: an electrically insulative core of a solid material that has a relative dielectric constant greater than 5 and occupies the major part of the interior volume defined by the core outer surface; a plurality of feed nodes; and an antenna element structure on or adjacent the core outer surface and comprising a plurality of elongate conductive antenna elements and, coupled between the elongate antenna elements and the feed nodes, a ring that is resonant at the operating frequency, the elongate antenna elements extending from the resonant ring in a direction away from the feed nodes.

In the case of the resonant phasing ring being associated with the first transversely extending surface portion, the elongate conductive antenna elements may extend over the side surface portion from the ring towards the second transversely extending surface portion, each such element being a helical track on a cylindrical side surface portion of the core. The two feed nodes preferably constitute a balanced feed point represented by conductive pads close to a central axis of the antenna, each such pad being connected to the phasing ring by respective inductive connecting links, the antenna further comprising a shunt capacitance coupled across the two feed nodes for matching purposes.

It is possible for the resonant phasing ring to comprise an annular conductive path on the side surface portion of the core at a position adjacent the first transversely extending surface portion, the elongate conductive antenna elements being helical and axially extensive.

According to yet another aspect of the invention, a dielectrically-loaded multifilar antenna for circularly polarised radiation having an operating frequency in excess of 200 MHz comprises: an electrically insulative core of a solid material that has a relative dielectric constant greater than 5 and occupies the major part of the interior volume defined by the core outer surface; a pair of feed nodes; and an antenna element structure on or adjacent the core outer surface and comprising a phasing ring connected to the feed nodes, and at least four elongate conductive elements coupled to the phasing ring at respective spaced-apart points on the ring.

The antenna may form part of an antenna assembly which comprises an antenna as described above in combination with a balun coupled to the feed nodes. The assembly may, instead, have a differential amplifier having a differential input coupled to the feed nodes.

In this specification, the term "radiating", when applied to elements of the antenna, refers to elements which radiate an electromagnetic field should the antenna be energised from a transmitter operating at the operating frequency of the antenna. It will be understood that when the antenna is coupled, instead, to a receiver, such elements absorb electromagnetic energy from the surroundings and the antenna then acts in a reciprocal way. It follows that statements and claims herein containing the term "radiating" embrace within their scope an antenna intended solely for use with a receiver as well as antennas used for transmitting.

The invention will be described below by way of example with reference to the drawings:—

DETAILED DESCRIPTION OF PREFERRED EMBODIMENTS

Figure 1:
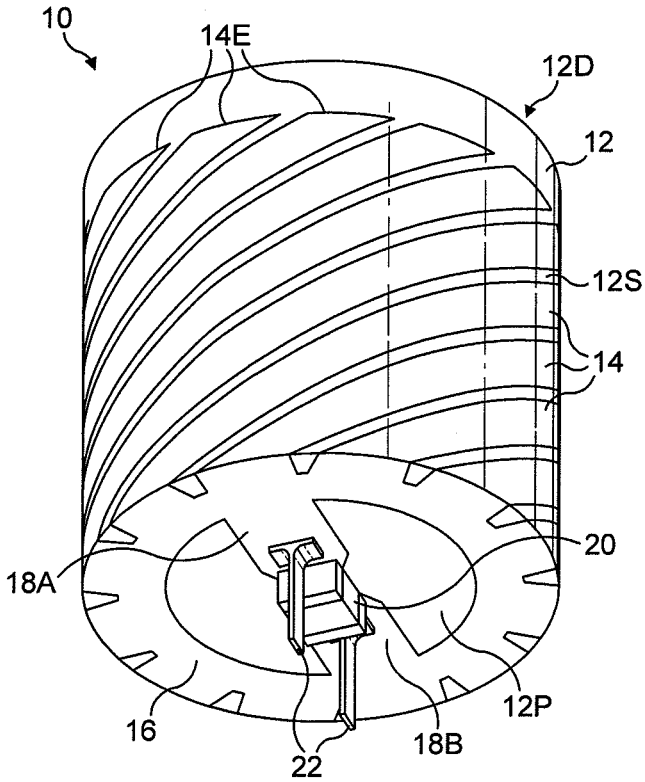
FIG. 1 is a perspective view of a first antenna in accordance with the invention, viewed from one side and from a proximal end.

Referring to FIG. 1, a first antenna in accordance with the invention comprises an end-fire dielectrically-loaded 12-filar antenna 10 having a cylindrical dielectric core 12, the core being made of a ceramic material typically having a relative dielectric constant of 36.

Plated on a cylindrical outer side surface portion 12 are axially coextensive half-turn helical tracks 14, each track forming an elongate conductive radiating element centred on a central axis (not shown) of the antenna defined by the cylindrical side surface portion 12S of the core. The core has a proximal core surface portion 12P which extends perpendicularly with respect to the antenna axis and the side surface portion 12S. This forms an end face of the antenna. The other end of the antenna is formed by a distal surface portion 12D of the core which also extends perpendicularly to the antenna axis and forms another end face.

Plated on the proximal core surface portion 12P is a conductive ring 16. Each of the helical radiating elements 14 extends over the edge formed by the intersection of the proximal surface portion 12P of the core and the cylindrical side surface portion 12S to meet the outer periphery of the conductive ring 16 on the proximal surface portion 12P, the respective connections of the helical elements 14 being uniformly distributed around the ring periphery.

Adjacent the distal end of the core 12P, the helical elements 14 terminate in open-circuit ends 14E. In this preferred embodiment of the invention, the helical elements 14 are all of the same length, each having an electrical length of a quarter wavelength at the operating frequency of the antenna, this length being the length of the respective element from its connection with the proximal conductive ring 16 to its open-circuit end 14E. In effect, the helical elements 14 comprise an array of open-ended monopole helical elements. In an alternative embodiment, the elements 14 may advantageously be quarter-turn rather than half-turn helices.

Extending inwardly and radially from the inner periphery of the conductive ring 16 and plated on the proximal core surface portion 12P are two feed connection conductors 18A, 18B which are connected to the conductive ring 16 at diametrically opposite positions. The inner end portions of the feed connection conductors, i.e. their end portions adjacent the central axis of the antenna, form feed nodes which, together, constitute a balanced feed connection for the antenna. Each feed connection conductor 18A, 18B forms a series inductance at the operating frequency of the antenna. Bridging the feed nodes constituted by the inner end portions of the feed connection conductors 18A, 18B is a shunt capacitor 20 which, together with the series inductances mentioned above, form a reactive matching network. A pair of metal spring connectors 22 extend proximally from the feed nodes for the purpose of connecting the antenna to receiver and/or transmitter circuitry.

The electrical length of the conductive ring 16 is a single wavelength at the operating frequency of the antenna, i.e. 360°. Accordingly, it is resonant at the operating frequency such that, when driven by signals at the operating frequency from the helical elements 14 (in the case of the antenna being used for receiving signals) or from the feed nodes (in the case of the antenna being used for transmission), resonant current circulates in the conductive ring 16, thereby rendering the antenna resonant in a circular polarisation mode owing to the resulting phase progression around the conductive ring 16 and around the proximal ends of the helical elements 14. Phasing of the helical elements 14 in this manner, by virtue of the distribution of current amplitudes and phases on the elements 14 effectively synthesises a spinning dipole and hence yields the desired circular polarisation characteristic.

In effect, therefore, the conductive ring 16 is a phasing ring which, in topological terms, is between the feed nodes and the radiating elements, the latter being driven from the feed nodes via this intermediate phasing ring. (Note that the feed nodes are on the inside of the conductive ring 16, whereas the radiating elements are on the outside.)

In this embodiment of the invention, the conductive ring 16 is continuous. However, as described hereinafter it is also possible to have, typically, two breaks, bridged with capacitors, which form part of an alternative matching network.

It is preferred that the conductive ring is circular, as shown, but this is not essential. Although, in this embodiment, there are 12 helical radiating elements, a smaller number may be used, e.g. ten, eight, six, or four. A common feature, however, is that the phasing ring forms a closed conductive loop resonant at the operating frequency. In this way, the ring 16 dictates the phasing of the helical elements 14, notwithstanding that the elements, in this case, all have the same length and configuration. Use of a resonant ring in this way, particularly when embodied as a plated conductor or conductor portions on the substrate formed by the core 12, forms an especially stable phasing element which can be produced comparatively inexpensively compared with lumped phasing networks, whilst maintaining a good manufacturing yield. In this example, with quarter-wave helical elements 14, the antenna impedance at the feed nodes is relatively low (typically a few ohms). As mentioned above, the feed nodes form a balanced feed point. Where the antenna is to be used with a single-ended receiver front end, the antenna may be connected to a printed circuit board mounting a proprietary balun circuit, as shown in FIG. 2.

Figure 2:
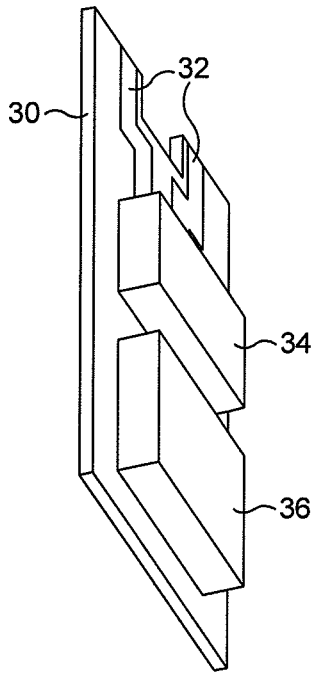
FIG. 2 is a perspective view of a printed circuit board bearing a balun and a front-end radiofrequency amplifier, the board being adapted to mount the antenna of FIG. 1.

Referring to FIG. 2, a receiver front-end circuit board 30 has printed tracks 32 for connection to the proximal pins 22 of the antenna (FIG. 1). The tracks 32 form connections between the antenna and the balun circuit, which may be a balun unit selected from the range manufactured by Johanson Technology, Inc. (Camarillo, Calif. 90312, USA) under the type number BL15. The balun circuit 34 provides a single-ended output for a radiofrequency front-end amplifier 36, also mounted on the printed circuit board 30.

The radiation pattern of the antenna is similar to that exhibited by conventional dielectrically-loaded quadrifilar antennas in that it is cardioid-shaped, having a distally directed axial maximum and being substantially omnidirectional in azimuth.

Figure 3A:
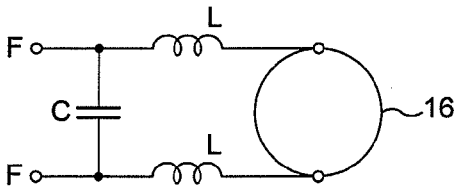
FIGS. 3A and 3B are equivalent circuit diagrams for the antenna.
Figure 3B:
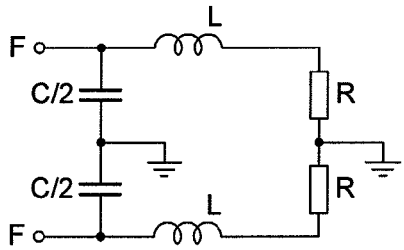

The matching network of the antenna of FIG. 1 is of the series inductance shunt-capacitance type, as illustrated by the equivalent circuits of FIGS. 3A and 3B. FIG. 3A shows the conductive ring 16 as a loop, each feed connection conductor 18A (FIG. 1) being represented by an inductance L, the capacitor 20 (FIG. 1) appearing as a shunt capacitance C across the feed nodes F. Referring to FIG. 3B, the phasing ring and associated helical elements may be represented by a resistance or resistances R. The equivalent circuit of FIG. 3B is shown as a balanced arrangement. Typically, the source impedance represented by the antenna and the matching network, when measured at the feed nodes F, is 50 ohms.

Figure 4A:
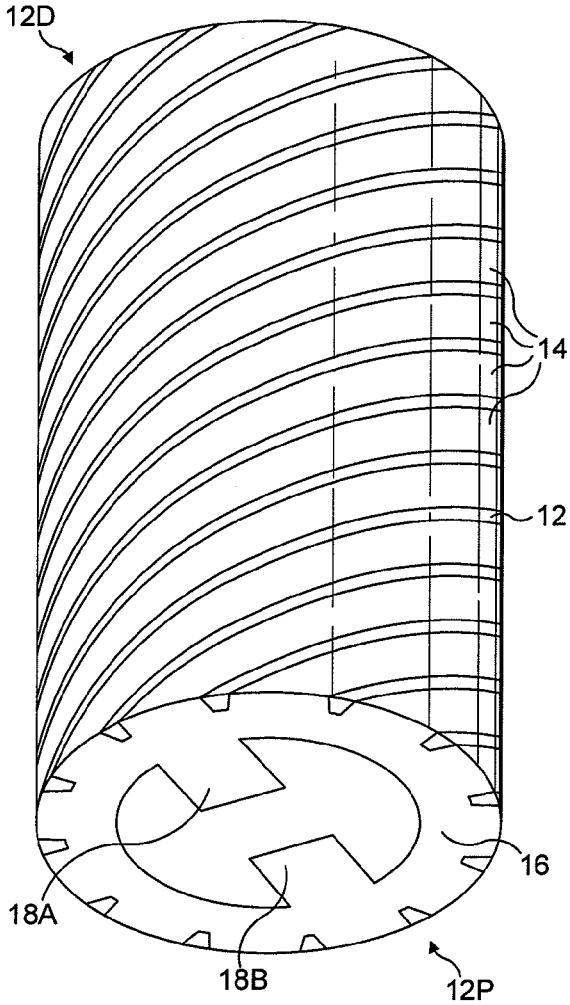
FIGS. 4A and 4B are perspective views of an antenna unit forming part of a second antenna in accordance with the invention, FIG. 4A showing the unit viewed from one side and a proximal end, and FIG. 4B showing the unit viewed from one side and a distal end.
Figure 4B:
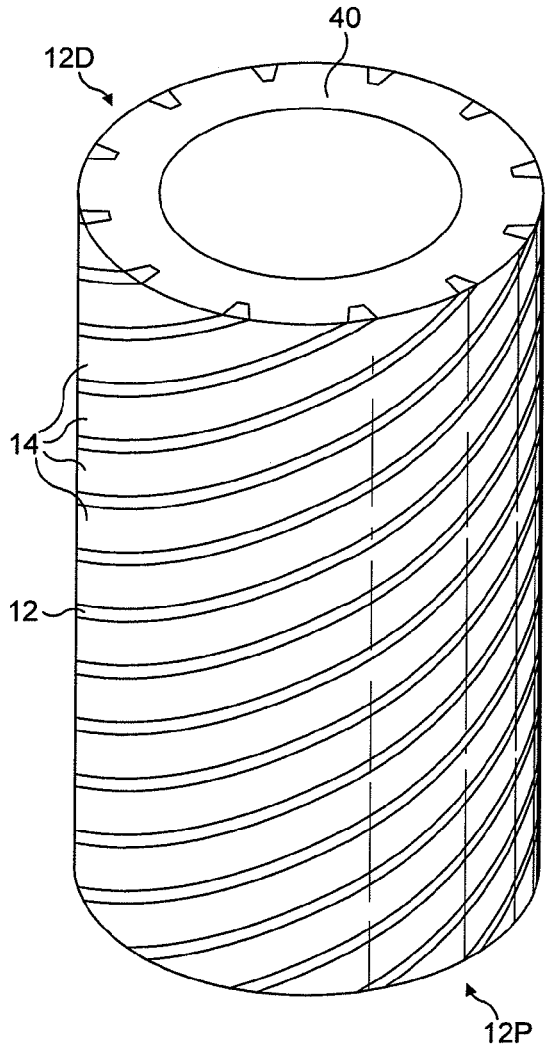

Referring to FIGS. 4A and 4B, a second antenna in accordance with the invention has two phasing rings for additional phasing stability. For simplicity, in the proximal view of FIG. 4A, the plated conductors on the proximal end surface portion 12P of the core are shown without connection pins and a shunt matching capacitor. In practice, the antenna includes these components, as described above with reference to FIG. 1. The artwork of the proximal end surface portion 12P is substantially the same as that of the first antenna described above with reference to FIG. 1. However, in this embodiment, the helical elements 14 each execute substantially a full turn around the core 12 and, as shown in FIG. 4B, extend over the edge formed by the intersection of the cylindrical side surface portion 12S and the distal end surface portion 12D to a second conductive ring 40 plated on the distal end surface portion 12D. In an alternative embodiment, the helical elements are half-turn elements.

The electrical length of each helical element 14 in this embodiment is a half wavelength at the operating frequency of the antenna. In variants of this antenna, the helical elements may have an electrical length of a full wavelength or higher integer multiples of a half wavelength. As in the first antenna described above with reference to FIG. 1, the electrical length of the proximal conductive ring 16 is a full wavelength, i.e. 360°. In this antenna, the distal conductive ring 40 is identically dimensioned. However, it is possible to arrange for the electrical lengths of the two conductive rings to differ in order to spread their resonant frequencies thereby to increase the bandwidth of the antenna.

Although, for a given core material and core diameter, the core 12 of this second antenna is longer and heavier than that of the first antenna, the second phasing ring offers greater phasing stability.

Figure 5A:
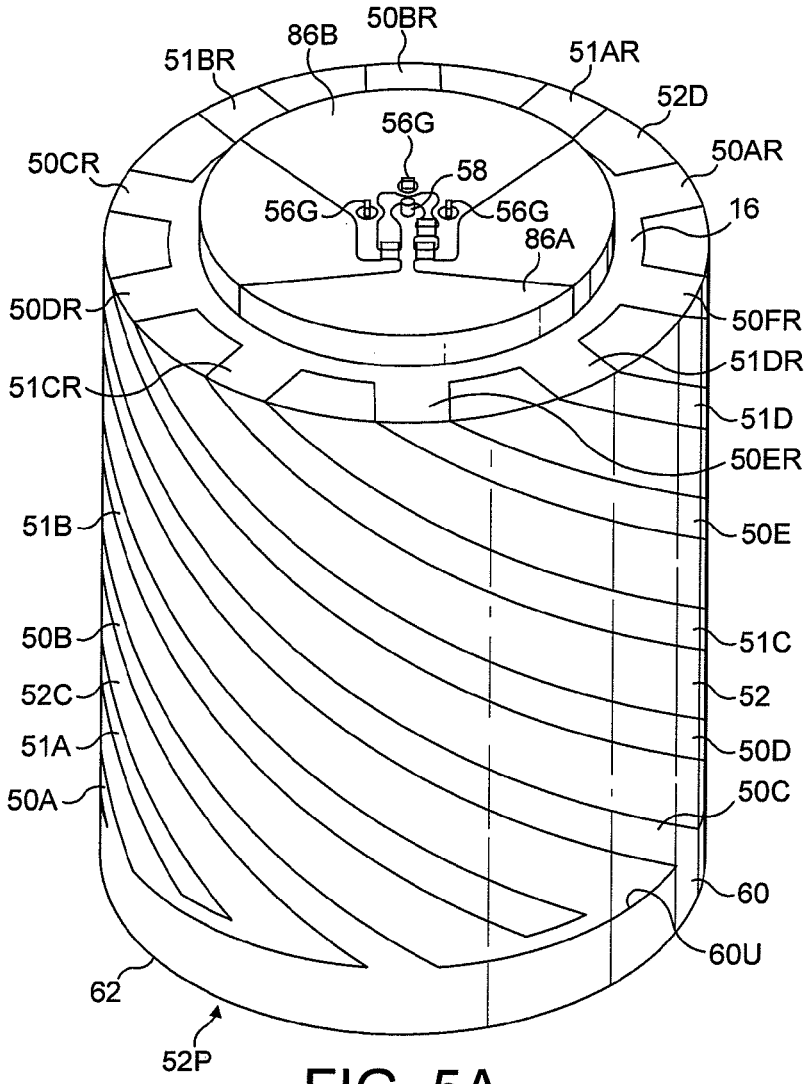
FIG. 5A is a perspective view of a third antenna in accordance with the invention, viewed from one side and from a distal end.
Figure 5B:
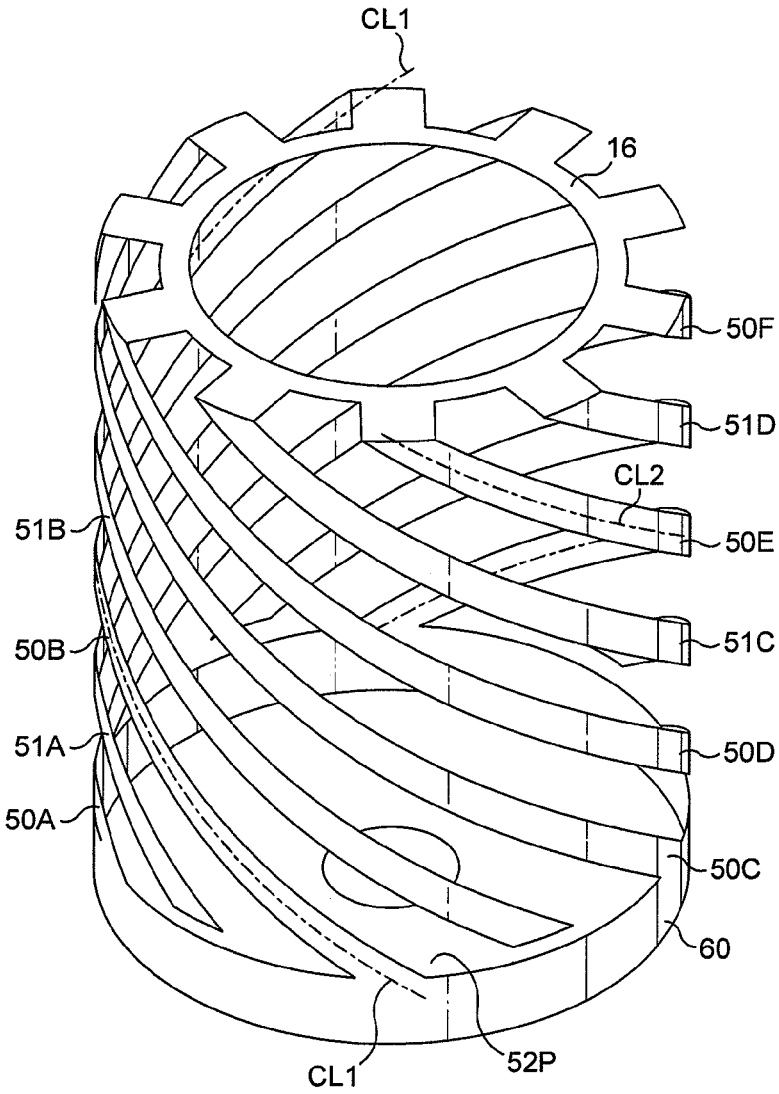
FIG. 5B is a diagrammatic representation of plated conductors of the third antenna, with the same viewpoint as FIG. 5A.

Referring to FIGS. 5A and 5B, a third antenna in accordance with the invention is a decafilar helical antenna having an antenna element structure with 10 elongate antenna elements constituted by two groups of such elements, one group comprising a plurality of closed-circuit helical conductive tracks 50A, 50B, 50C, 50D, 50E, 50F and another group comprising a plurality of open-circuit conductive tracks 51A, 51B, 51C, 51D, these tracks all being plated or otherwise metallised on the cylindrical outer surface portion 52C of a solid cylindrical core 52. In FIG. 5B, the core and other components are omitted for clarity.

The core is made of a ceramic material. In this case it is a titanate material having a relative dielectric constant in the region of 36. In this embodiment, which is intended for operation in the GPS L1 and L2 bands (1575.42 MHz and 1227.6 MHz), the core has a diameter of 14 mm. The length of the core, at 17.75 mm, is greater than the diameter, but in other embodiments it may be less.

Figure 6:
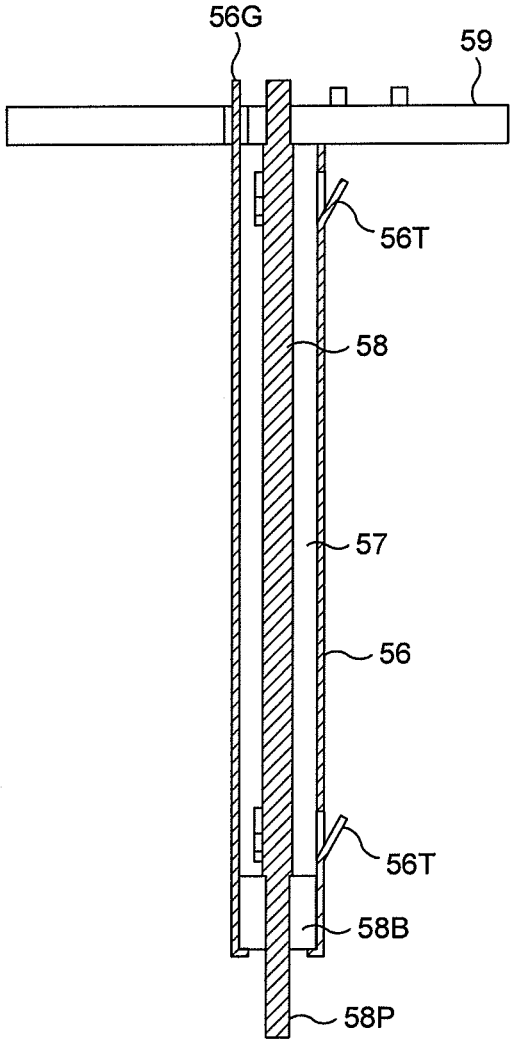
FIG. 6 is an axial cross-section of a feed structure of the third antenna.

This third antenna is a backfire helical antenna in that it has a coaxial transmission line feeder housed in an axial bore (not shown) that passes through the core from a distal end face 52D to a proximal end face 52P of the core. Both end faces 52D, 52P are planar and perpendicular to the central axis of the core. They are oppositely directed, in that one is directed distally and the other proximally in this embodiment of the invention. The coaxial transmission line is a rigid coaxial feeder which is housed centrally in the bore with the outer shield conductor spaced from the wall of the bore so that there is, effectively, a dielectric layer between the shield conductor and the material of the core 52. Referring to FIG. 6, the coaxial transmission line feeder has a conductive tubular outer shield 56, a first tubular air gap or insulating layer 57, and an elongate inner conductor 58 which is insulated from the shield by the insulating layer 57. The shield 56 has outwardly projecting and integrally formed spring tangs 56T or spacers which space the shield from the walls of the bore. A second tubular air gap exists between the shield 56 and the wall of the bore. The insulative layer 57 may, instead, be formed as a plastics sleeve, as may the layer between the shield 56 and the walls of the bore. At the lower, proximal end of the feeder, the inner conductor 58 is centrally located within the shield 56 by an insulative bush (not shown), as described in our above-mentioned WO2006/136809.

The combination of the shield 56, inner conductor 58 and insulative layer 57 constitutes a transmission line of predetermined characteristic impedance, here 50 ohms, passing through the antenna core 52 in an axial bore (not shown) for coupling distal ends of the helical tracks 50A-50F, 51A-51D to radio frequency (RF) circuitry of equipment to which the antenna is to be connected. The couplings between the antenna elements 50A-50F, 51A-51D and the feeder are made via conductive connection portions associated with the helical tracks 50A-50F, 51A-51D, these connection portions being formed as short radial tracks 50AR, 50BR, 50CR, 50DR, 50ER, 50FR, 51AR, 51BR, 51CR, 51DR, plated on the distal end face 52D of the core 52. Each connection portion extends from a distal end of the respective helical track to the outer edge of a distal conductive phasing ring 16 plated on the core distal face 52D adjacent the end of the axial bore in the core. As will be seen from FIG. 5B, the phasing ring 16 is nearer the periphery of the distal face 52D of the core and the proximal ends of the helical tracks 50A-50F, 51A-51D than it is to the central axis of the antenna and the axial transmission line feeder section (described above with reference to FIG. 6). In this embodiment of the invention, the phasing ring 16 has an average diameter of 11 mm and an electrical length equivalent to a full wavelength, i.e. 360°, at a first operating frequency which is the GPS L1 frequency, 1575.42 MHz. The open-circuit helical tracks 51A-51D are also resonant at the first operating frequency of the antenna, 1575.42 MHz, and are connected to the distal phasing ring 16 at angularly spaced apart positions by their respective connection portions 51AR-51DR, as shown in FIG. 5B. Although they are not exactly uniformly distributed around the phasing ring 16, the distribution is sufficiently even for the four open-circuit elements to be phased in order to produce a circular polarisation response in this first mode of resonance of the antenna.

The closed-circuit helical tracks 50A-50F, representing a second group of radiating elements, are resonant at a second, lower operating frequency, the GPS L2 frequency, 1227.60 MHz, representing a second mode of resonance of the antenna. They are also connected to the distal phasing ring 16 at angularly spaced apart positions by their respective connection portions 50AR-50FR, as will be described hereinafter.

The distal phasing ring 16 is coupled via a matching network to the shield and inner conductors 16, 18 of the axial transmission line section by conductors on a laminate board 59 secured to the core distal face 52D, as will also be described hereinafter. The coaxial transmission line feeder section and the laminate board 59 together comprise a unitary feed structure before assembly into the core 52, and their interrelationship may be seen by comparing FIGS. 5A and 6.

The electrical length of the phasing ring 16 is also determined by factors including its physical path length, the relative dielectric constant of the core material, and the configuration, placement and material of the laminate board 59.

Referring again to FIG. 6, the inner conductor 58 of the transmission line feeder has a proximal portion 58P which projects as a pin from the proximal face 52P of the core 52 for connection to the equipment circuitry. Similarly, integral lugs (not shown) on the proximal end of the shield 56 project beyond the core proximal face 52P for making a connection with the equipment circuitry ground.

The proximal ends of the six closed-circuit helical tracks 50A-50F of the first group are interconnected by a common virtual ground conductor 60. In this embodiment, the common conductor is a second annular phasing ring and is in the form of a plated sleeve surrounding a proximal end portion of the core 52. This sleeve 60 is, in turn, connected to the shield conductor 56 of the feeder, where it emerges proximally from the core, by a plated conductive covering 62 of the proximal end face 52P of the core 52 (FIG. 1).

The six closed-circuit helical tracks 50A-50F of the first group are of different lengths, each set 50A-50C, 50D-50F of three elements having elements of slightly different lengths as a result of the rim 60U of the sleeve generally being of varying distance from the proximal end face 52P of the core. Where the shortest elements 50A, 50D are connected to the sleeve 60, the rim 20U is a little further from the proximal face 52P than where the longest antenna elements 50C, 50F are connected to the sleeve 60. The differing lengths of the conductive paths containing the closed-circuit helical tracks 50A-50F result in phase differences between the currents in the elements within each set 50A-50C, 50D-50F of three elements when the antenna operates in the second mode of resonance in which the antenna is sensitive to circularly polarised signals, in this case at the GPS L2 frequency, 1227.60 MHz. In this mode, currents flow around the rim 60U of the sleeve 60 between, on the one hand, the elements 50D, 50E, 50F connected to the distal phasing ring 16 on one side of the core 52 and, on the other hand, the elements of the other of the sets 50A, 50B, 50C connected to the distal phasing ring 16 on the opposite side of the core 52.

The conductive sleeve 60, the plating 62 of the proximal end face 52P, and the outer shield 56 of the feed line 56, 58 together form a quarter-wave balun which provides common-mode isolation of the antenna element structure from the equipment to which the antenna is connected when installed. The balun converts the single-ended currents at the proximal end of the feed line 56, 58 to balanced currents at the distal end where it emerges on the distal end surface portion 52D of the core 52.

The rim 60U of the sleeve 60 has an electrical length of $\lambda_{g2}$, $\lambda_{g2}$ being the guide wavelength for currents passing around the rim 60U at the frequency of the second resonant mode of the antenna, so that the rim exhibits a ring resonance at that frequency. The operation of the sleeve rim 60U as a resonant element is described in more detail in the above-mentioned EP1147571A.

Whilst the sleeve 60 and plating 62 of this embodiment of the invention are advantageous in that they provide both a balun function and a ring resonance, a ring resonance can also be provided independently by connecting the helical tracks 50A-50F of the second group to an annular conductor which encircles the core 52 and has both proximal and distal edges on the outer side surface portion of the core as in the embodiment described above with reference to FIGS. 4A and 4B, rather than being in the form of a sleeve connected to the feeder shield conductor 56 to form an open-ended cavity, as in the present embodiment. Such a conductor may be comparatively narrow insofar as it may constitute an annular track the width of which is similar to the width of conductive tracks forming the helical tracks 50A-50F, 51A-51D and, providing it has an electrical length corresponding to the guide wavelength at an operating frequency of the antenna, still produces a ring resonance reinforcing the resonant mode associated with the loops provided by the closed-circuit helical tracks 50A-50F and their interconnection, i.e. the second resonant mode.

It will be understood that the rim 60U of the sleeve 60 acts as a second, proximal phasing ring to reinforce the circular polarisation resonance at the lower operating frequency, i.e. 1227.60 MHz. Whereas, as described above, the sleeve rim 60U is located on the outer cylindrical surface portion 52C of the core 52, in another variant, the balun may comprise solely a disc-shaped conductor on the proximal face 52P of the core 52, with the helical tracks 50A-50F of the second group extending onto the proximal surface portion 52P of the core 52, so as to form a phasing ring located entirely on the proximal end face portion 52P.

The sleeve 60 and proximal surface plating 62 act as a trap preventing the flow of currents from the closed-circuit helical tracks 50A-50F to the shield 56 of the feed line at the proximal end face 52P of the core. It will be noted that the closed-circuit helical tracks 50A-50F may be regarded as two subsets of three helical tracks interconnected by the distal phase ring 16 so that each subset of closed-circuit helical tracks typically has one long track 50C; 50F, one intermediate length track 50B; 50E and one short track 50A; 50D.

The three conductive loops running between the opposite sides of the phasing ring 16 formed, respectively, by (a) the shortest closed-circuit helical tracks 50A, 50D and the sleeve rim 60U, (b) the intermediate length closed-circuit helical tracks 50B, 50E and the sleeve rim 60U, and (c) the longest closed-circuit helical tracks 50C, 50F and the sleeve rim 60U each have an effective electrical length approximately equal to $\lambda_{g2}$, which is the guide wavelength along the loops at the frequency of the second resonant mode. These radiating elements are half-turn elements and are coextensive on the cylindrical surface portion 52C of the core. The configurations of the closed-circuit helical tracks 50A-50F and their interconnection are such that they operate similarly to a simple dielectrically loaded hexafilar helical antenna, the operation of which is described in more detail in the above-mentioned GB2445478A.

In contrast to the closed-circuit helical tracks 50A-50F, the other helical conductor tracks 51A-51D have open-circuit proximal ends on the core cylindrical surface portion 52C at locations between the distal end surface portion 52D of the core and the sleeve rim 60U, as shown in FIGS. 5A and 5B. The arrangement of these open-circuit helical tracks is such that they are also uniformly distributed around the core, being interleaved between the closed-circuit helical tracks 50A-50F, each open-circuit track 51A-51D executing approximately a half-turn around the axis of the core. Being uniformly distributed around the axis of the core, the open-circuit helical tracks 51A-51D comprise generally orthogonally located track pairs 51A, 51C; 51B, 51D. Each open-circuit track 51A-51D forms, in combination with its respective radial connection element 51AR-51DR on the core distal end surface portion 52D, a three-quarter-wave monopole in the sense that, in this embodiment, the electrical length of each track is approximately equal to three quarters of the guide wavelength $\lambda_{g1}$ along the tracks at the frequency of a first circularly polarised resonant mode of the antenna determined inter alia by the length of the open-circuit elements. In this embodiment, the frequency of the first circularly polarised resonant mode is the GPS L1 frequency, 1575.42 MHz.

As is the case with the closed-circuit helical conductor tracks 50A-50F, the open-circuit tracks 51A-51D also exhibit small differences in physical and electrical length. Thus, the open-circuit tracks include a first pair of diametrically opposed tracks 51A, 51C which are longer than a second pair of diametrically opposed tracks 51B, 51D. These small variations in length phase-advance and phase-retard their respective individual resonances to aid in synthesising a rotating dipole at the frequency of the first circularly polarised resonant mode.

It should be noted that, in this embodiment of the invention, the frequency of the first resonant mode is higher than that of the second resonant mode. In other embodiments, the opposite may be true. Fundamental or harmonic resonances of the helical elements may be used, although in general, the closed-circuit elements have an average electrical length of $n\lambda_{g2}/2$ and the open-circuit elements have an average electrical length of $(2m-1)\ \lambda_{g1}/4$, where n and m are positive integers.

Since there is no connection of the system of monopole elements formed by the open-circuit helical tracks 51A-51D and their respective radial tracks 51AR-51DR to the sleeve rim 60U, the first circularly polarised resonant mode is determined independently of the ring resonance of the sleeve rim 60U. Nevertheless, the distal phasing ring 16 and balun formed by the sleeve 60, the feeder 56, 58 and their interconnection by the plated layer 62 of the proximal end surface portion 52P of the core (which reduces the effect of the self-capacitance of the shield conductor 56) improve the matching of the quadrifilar monopoles 51A-51D, thereby producing a stable circularly polarised radiation pattern in the first resonant mode. In addition, the tolerances on the monopole lengths are less critical as a result.

In this specification, the term "radiation" and "radiating" are to be construed broadly in the sense that, when applied to characteristics or elements of the antenna, they refer to characteristics or elements of the antenna associated with the radiation of energy when it is used with a transmitter or which are associated with the absorption of energy from the surroundings, in a reciprocal manner, when the antenna is used with a receiver.

In respect of the two sets of five helical tracks 50A, 51A, 50B, 51B, 50C; 50D, 51C, 50E, 51D, 50F connected to the distal phasing ring 16, the sequence of closed-circuit tracks 50A, 50B, 50C; 50D, 50E, 50F and open-circuit tracks 51A, 51B; 51C, 51D respectively around the core is such that it is symmetrical about a centre line CL1; CL2 (see FIG. 5B). In other words, for each feed coupling node, the sequence is mirrored about the respective centre line. More particularly, the arrangement of the helical tracks is such that, in respect of the helical track elements connected to each feed coupling node, they comprise pairs of neighbouring antenna elements, each pair comprising one closed-circuit antenna element and one open-circuit antenna element, and the sequence of antenna elements is such that, in a given direction around the core, the number of pairs in which a closed-circuit element precedes an open-circuit element is equal to the number of pairs in which, in the same direction the open circuit element precedes the closed circuit element. Bearing in mind that, in the present context, each such "pair" of elements can include at least one element which is also an element of another such pair, the antenna elements coupled to one side of the distal phasing ring 16 comprises four pairs 50A, 51A; 51A, 50B; 50B, 51B; and 51B, 50C. Of these four pairs, viewing the sequence from above the antenna (i.e. from a position located distally of the distal core surface portion 52D) in an anticlockwise direction there are two pairs 50A, 51A; 50B, 51B in which the closed-circuit element precedes the open circuit element and two pairs 51A, 50B; 51B, 50C in which the open-circuit element precedes the closed-circuit element, thereby satisfying the condition of equal numbers of pairs, as specified above. The same is true of the antenna elements connected to the other side of the phasing ring 16. Thus, there are two pairs 50D, 51C; 50E, 51D in which the closed-circuit element precedes the open-circuit element and two pairs 51C, 50E, 51D, 50F in which the open-circuit element precedes the closed-circuit element. This sequencing of closed-circuit and open-circuit elements has been found to produce a superior radiation pattern in comparison to an antenna which does not meet this condition.

It is possible to meet the condition with an antenna having four closed-circuit elements and four open-circuit elements only. However, the combination of six elements of one kind and four of the other kind, i.e. in this case, six closed-circuit elements and four open-circuit elements, is preferred because a more uniform spacing of the elements of each group 50A-50F; 51A-51D can be obtained. Accordingly, given that the complete set of antenna elements 50A-50F, 51A-51D is uniformly distributed around the core, in any given plane perpendicular to the antenna axis, the closed-circuit helical tracks 50A-50F have angular spacings of 72° (in respect of four pairs of tracks) and 36° (in respect of two pairs of tracks). The maximum deviation from the optimum spacing of 60° is 24°. With regard to the four open-circuit helical tracks 51A-51D, the inter-element angular spacings are 72° and 108°, i.e. yielding a deviation of only 18° from the 90° optimum.

Impedance matching is performed by a matching network embodied in a laminate printed circuit board (PCB) assembly 59 mounted face-to-face on the distal end surface portion 52D of the core, as shown in FIG. 1.

The PCB assembly 59 forms part of a feed structure incorporating the feed line 56, 58, as shown in FIG. 6.

The feed line 56, 58 performs functions other than simply that of a line having a characteristic impedance of 50 ohms for conveying signals to or from the antenna element structure. Firstly, as described above, the shield 56 acts in combination with the sleeve 60 to provide common-mode isolation at the point of connection of the feed structure to the antenna element structure. The length of the shield conductor between (a) its connection with the plating 62 on the proximal end face 52P of the core and (b) its connection to conductors on the PCB assembly 59, together with the dimensions of the axial bore (in which the feeder transmission line is housed) and the dielectric constant of the material filling the space between the shield 56 and the wall of the bore, are such that the electrical length of the shield 56 on its outer surface is about a quarter wavelength at each of the frequencies of the two required modes of resonance of the antenna, so that the combination of the conductive sleeve 60, the plating 62 and the shield 56 produces balanced currents at the connection of the feed structure to the antenna element structure.

In this preferred antenna, there is an insulative layer surrounding the shield 16 of the feed structure. This layer, which is of lower dielectric constant than the dielectric constant of the core 52, and is an air layer in the preferred antenna, diminishes the effect of the core 52 on the electrical length of the shield 56 and, therefore, on any longitudinal resonance associated with the outside of the shield 56. Since the modes of resonance associated with the required operating frequencies are characterised by voltage dipoles extending diametrically, i.e. transversely of the cylindrical core axis, the effect of the low dielectric constant sleeve on the required modes of resonance is relatively small due to the sleeve thickness being, at least in the preferred embodiment, considerably less than that of the core. It is, therefore, possible to cause the linear mode of resonance associated with the shield 56 to be de-coupled from the wanted modes of resonance.

The antenna has resonant frequencies determined by the effective electrical lengths of the helical antenna elements 50A-50F, 51A-51D, as described above. The electrical lengths of the elements, for a given frequency of resonance, are also dependent on the relative dielectric constant of the core material, the dimensions of the antenna being substantially reduced with respect to an air-cored quadrifilar antenna. Since the phasing rings are plated on the core material, their dimensions are also substantially reduced with respect to full wavelength rings in air.

Antennas in accordance with the invention are especially suitable for dual-band satellite communication above about 1 GHz. In this case, the helical antenna elements 50A-50F of the second group have an average longitudinal extent (i.e. parallel to the central axis) of about 16 mm whilst those 51A-51D of the first group have an average longitudinal extent of about 15.5 mm. The length of the conductive sleeve 20 is typically in the region of 1.75 mm. This yields a quarterwave balun at approximately the frequencies of the two frequency bands of operation. This dimension is not critical. Indeed, the sleeve length may be set to yield a quarterwave balun action at either of the two centre frequencies or any frequency in between in many cases, depending on the spacing between the centre frequencies. Generally it is desirable that the sleeve forms a quarterwave balun at the mean of the centre frequencies.

Precise dimensions of the antenna elements 50A-50F and 51A-51D can be determined in the design stage on a trial and error basis by undertaking empirical optimisation until the required phase differences are obtained. The diameter of the coaxial transmission line in the axial bore of the core is in the region of 2 mm.

Further details of the feed structure will now be described. As shown in FIG. 6, the feed structure comprises the combination of the coaxial 50 ohm feed line 56, 57, 58 and the planar laminate board assembly 59 connected to a distal end of the line. The PCB assembly 59 is a multiple layer printed circuit board that lies flat against the distal end face 52D of the core 52 in face-to-face contact. The largest dimension of the PCB assembly 59 is smaller than the diameter of the core 52 so that the PCB assembly 59 is fully within the periphery of the distal end face 52D of the core 52, as shown in FIG. 1.

In this embodiment, the PCB assembly 59 is in the form of a disc centrally located on the distal face 52D of the core. Its diameter is such that its periphery overlies the distal phasing ring 16 plated on the core distal surface portion 52D. As shown in the exploded view of FIG. 6A, the assembly 59 has a substantially central hole 72 which receives the inner conductor 58 of the coaxial feeder transmission line. Three off-centre holes 74 receive distal lugs 56G of the shield 56. The lugs 56G are bent or "jogged" to assist in locating the PCB assembly 59 with respect to the coaxial feeder structure. All four holes 72, 74 are plated through. In addition, portions 59P of the periphery of the assembly 59A, 59PB, are plated, the plating extending onto the proximal and distal faces of the laminate board.

Figure 6A:
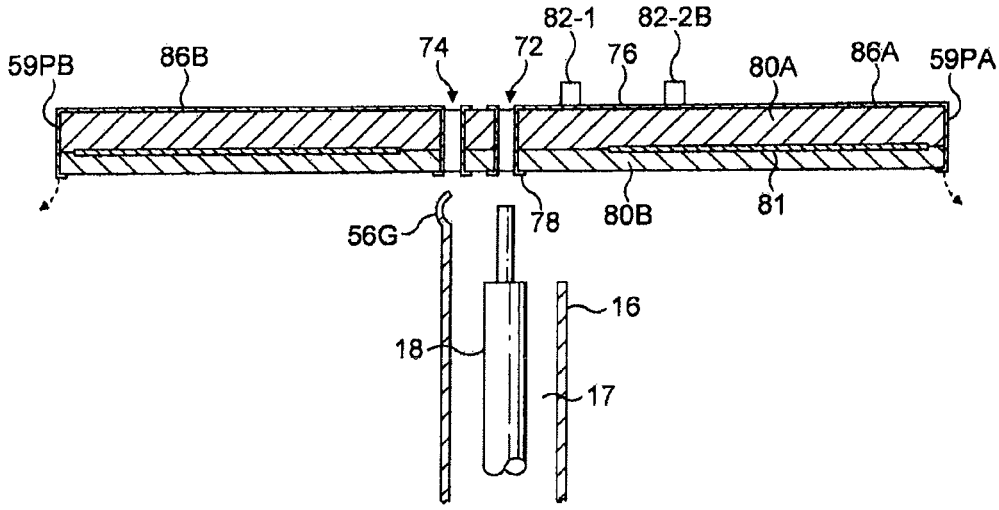
FIG. 6A is a detail of the feed structure shown in FIG. 6, showing a laminate board thereof detached from a distal end portion of a transmission line feeder section.
Figure 7A:
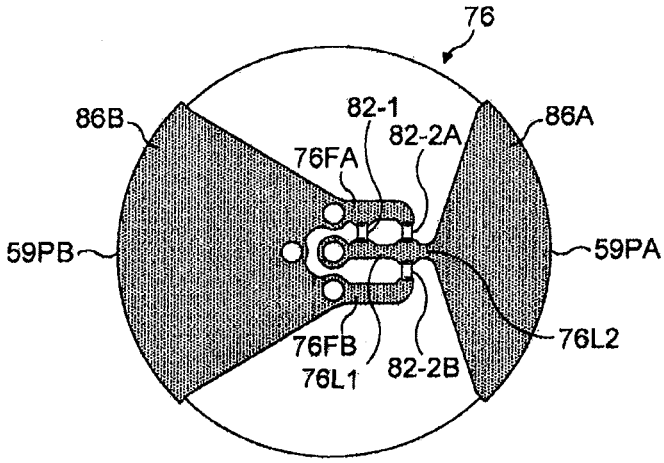
FIGS. 7A and 7B are diagrams showing conductor patterns of conductive layers of the laminate board of the feeder structure.
Figure 7B:
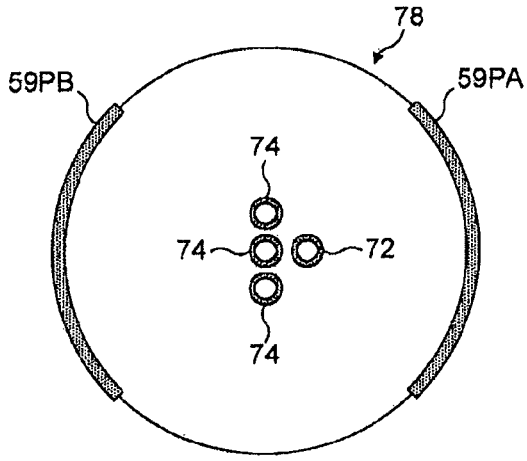

The PCB assembly 59 has a laminate board in that it has a insulative layers and three patterned conductive layers. Additional insulative and conductive layers may be used in alternative embodiments of the invention. As shown in FIG. 6A, in this embodiment, there are two outer conductive layers comprise a distal layer 76 and a proximal layer 78 which are separated by the insulative layers 80A, 80B. These insulative layers 80A, 80B are made of FR-4 glass-reinforced epoxy board. Between the insulative layers 80A, 80B is an intermediate conductor layer 81. The distal and proximal conductor layers are each etched with a respective conductor pattern, as shown in FIGS. 7A and 7B respectively. Where the conductor pattern extends to the peripheral portions 59PA, 59PB of the laminate board and to the plated-through holes 72, 74, the respective conductors in the different layers are interconnected by the edge plating and the hole plating respectively. As will be seen from the drawings showing the conductor patterns of the conductor layers 76, 78, the distal conductive layer 76 has an elongate conductor track 36L1, 36L2 which connects the inner feed line conductor 58, when it is housed in the central hole 72 in the laminate board, to a first peripheral plated edge portion 59PA of the board via a low-inductance outwardly flaring first fan-shaped current-distributing conductor 86A. At its outer extremity, formed by the first plated periphery edge portion 59PA, the fan-shaped conductor 86A subtends an angle of 90° at the core axis. The elongate track between the inner feed conductor 58 and the fan-shaped conductor 86A is in two parts 76L1, 76L2 which, owing to their relatively narrow elongate shape, constitute inductances at the frequencies of operation of the antenna. Since the first peripheral edge portion 59PA is connected to the distal ring 16 in the region of half of the radial conductors 50DR, 50ER, 50FR, 51CR, 51DR on the distal end face 52D of the core (FIG. 5A), these inductances are in series between the inner feed line conductor 18 and the respective helical antenna elements, i.e. two of each group 50A-50F; 51A-51D.

The feed line shield 56, when housed in the holes 74 in the laminate board, is connected directly to the opposite peripheral plated edge portion 59PB of the board by a second outwardly flaring fan-shaped current distributing conductor 86B which, owing to its relatively large area, also has low inductance. Accordingly, the shield is effectively connected directly to the phasing ring 16 in the region of the other radial conductors 10AR, 50BR, 50CR, 51AR, 51BR. The second fan-shaped conductor 86B is extended towards the first fan-shaped conductor 86A alongside the inductive elongate track 36L1, 36L2, to provide pads for discrete shunt capacitances. Thus, in this embodiment, the second fan-shaped conductor 86B has two extensions 76FA, 76FB running parallel to the inductive track 76L1, 76L2 on opposite sides thereof. Each extension 76FA, 76FB is formed as a track that is much wider and, therefore, of negligible inductance, compared to the central inductive track. One of these extensions 76FA provides pads for a first chip capacitor 82-1, connected to the plating associated with the central hole 72, and a second chip capacitor 82-8A, connected to the junction between the two inductive track parts 76L1, 76L2. The other extension 36FB provides a pad for a third chip capacitor 82-2B which is also connected to the junction between inductive track parts 76L1, 76L2. In this embodiment of the invention, the capacitors 82-1, 82-2A, 82-2B are 0201-size chip capacitors (e.g. Murata GJM). It will be noted that, being on the distal surface of the laminate board 59, the fan-shaped conductors 86A, 86B are spaced from the distal end face 52P of the core and are not, therefore, substantially loaded by the dielectric material of the core.

Figure 8:
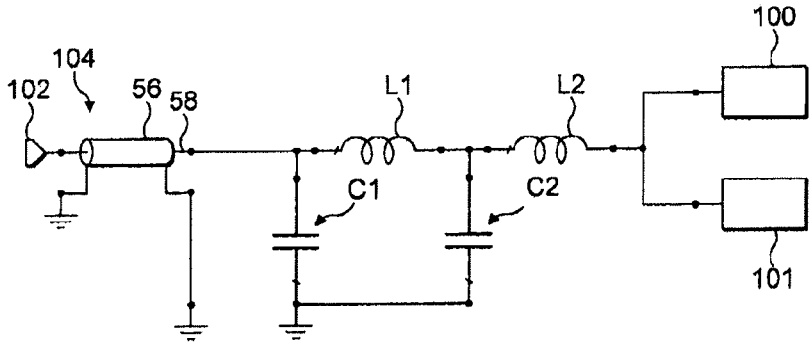
FIG. 8 is an equivalent circuit diagram.

The above-described combination constitutes a 2-pole reactive matching network shown schematically in FIG. 8. The network provides a dual-band match between (a) subcircuits 100, 101 respectively representing the source constituted by the closed-circuit helical elements 50A-50F and associated parts, and the source constituted by the open-circuit helical elements 51A-51D and associated parts, and (b) a 50 ohm load 102. In this example, the feed line 56-58 (FIGS. 6 and 6A) is a 50 ohm coaxial line section 104. Inductors L1 and L2 are formed by the track sections 76L1, 76L2 referred to above. The shunt capacitance C1 is that indicated as capacitor 82-1 in FIGS. 6A and 7A. The other shunt capacitance C2 is formed by the parallel combination of the two chip capacitors 82-2A, 82-2B described above with reference to FIG. 7A. Using two capacitors for the second capacitance C2 allows a relatively high capacitance value to be obtained using low profile chip capacitors and reduces resistive losses.

The conductor pattern of the intermediate conductive layer 81 is in the form of a simple ring spaced from the peripheral edge conductors 59PA, 59PB and from the vias represented by the plated holes 72, 74. This ring or washer bounds the electromagnetic fields associated with the phasing ring 16, thereby lowering its resonant frequency to the first operating frequency.

Connections between the feed line 56, 58, the PCB assembly 59 and the conductive tracks on the distal face 52D of the core are made by soldering or by bonding with conductive glue. The feed line 56-58 and the assembly 59 together form a unitary feeder structure when the distal end of the inner conductor 58 is soldered in the via 72 of the laminate board, and the shield lugs 56G in the respective off-centre vias 74. The feed line 56-58 and the PCB 59 together form a unitary feed structure with an integral matching network.

The network constituted by the series inductances L1, L2 and the shunt capacitances C1, C2 forms a matching network between the radiating antenna element structure of the antenna and a 50 ohm termination at the proximal end of the transmission line section when connected to radio frequency circuitry, this 50 ohm load impedance being matched to the impedance of the antenna element structure at its operating frequencies. The shunt impedance represented by the matching network also has the beneficial effects of permitting wider tolerances for the monopole antenna elements 51A-51D, and an improved respective radiation pattern.

Figure 9:
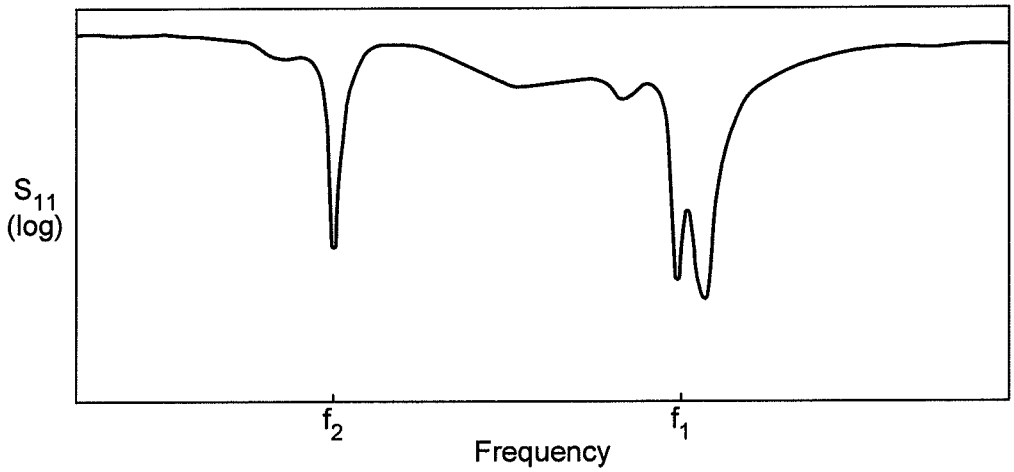
FIG. 9 is a graph illustrating the insertion loss ($S_{11}$) frequency response of the third antenna.

As stated above, the feed structure is assembled as a unit before being inserted in the antenna core 52, the laminate board of the assembly 19 being fastened to the coaxial line 16-18. Subsequent steps in the manufacture of the third antenna are as described in WO2006/136809 mentioned above Using the structure described above, it is possible to create a dual-band circularly polarised frequency response, the insertion-loss-versus-frequency graph of the antenna being generally as shown in FIG. 9. The antenna has a first band centred on a upper resonant frequency $f_1$ and a second band centred on an lower resonant frequency $f_2$. In this antenna, the frequency separation $f_2-f_1$ of the two centre frequencies is about 25 percent of the mean frequency $\frac{1}{2}(f_1+f_2)$. It has a predominantly upwardly directed radiation pattern in respect of right-hand circularly polarised waves in both bands.

It will be appreciated that an antenna in accordance with the invention can be adapted for left-hand circularly polarised waves. One service using left-hand circularly polarised waves is the GlobalStar voice and data communication satellite system which has a band for transmissions from handsets to satellites centred on about 1616 MHz and another band for transmissions from satellites to handsets centred on about 2492 MHz.

Figure 10:
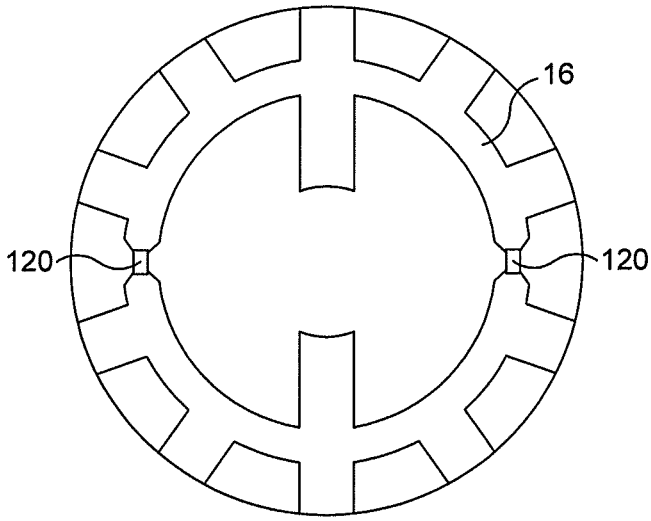
FIG. 10 is a diagram showing a modified distal end conductor pattern for the third antenna.

Referred to above is the possibility of the phasing ring 16 being non-continuous, with breaks bridged by capacitors. Such a variant offers greater flexibility in choosing the resonant frequency of the phasing ring within a given space. The capacitors may, in addition, form part of an alternative impedance matching network. Once such variant is illustrated in FIG. 10, which is a plan view of an end face of a cylindrical core 52 having plated thereon a phasing ring 16 with two breaks bridged by respective capacitors 120. In this variant, the phasing ring is connected at its outer periphery to 10 helical radiating elements using short radial connecting portions as described above with reference to FIGS. 5A and 5B. No feed structure is shown in FIG. 10. In practice, a PCB matching network having the same general physical configuration as described above may be used. Alternatively, inwardly extending radial feed connection conductors 18A, 18B couple the phasing ring 16 directly to an axially located transmission line feeder or, in the case of an end-fire antenna, to an axially located circuit board such as that described above with reference to FIG. 2.

What is claimed is:

1. A multifilar antenna for circularly polarised radiation having an operating frequency in excess of 200 MHz, wherein the antenna comprises an electrically insulative core of a solid material that has a relative dielectric constant greater than 5 and occupies the major part of the interior volume defined by the core outer surface, a pair of feed nodes, at least four elongate conductive radiating elements located on the substrate, and, arranged between and coupling together the feed nodes and the radiating elements, a phasing ring formed by a closed loop which is resonant at the operating frequency, the phasing ring having an inner periphery and an outer periphery, wherein the radiating elements are coupled to the phasing ring at respective spaced apart coupling locations, at the outer periphery of the phasing ring, and the feed nodes are coupled to the inner periphery of the phasing ring.

2. An antenna according to claim 1, wherein the antenna has a central axis and the phasing ring comprises a conductive track located on the substrate and encircling the axis.

3. An antenna according to claim 1, wherein the phasing ring comprises a continuous annular conductor.

4. An antenna according to claim 1, wherein the phasing ring includes at least a pair of lumped reactances in series with conductive track portions, which portions, together with the reactances, form the said closed loop which is resonant at the operating frequency.

5. An antenna according to claim 1, wherein the cylindrical body having a cylindrical side surface portion and proximal and distal end surface portions, and wherein the phasing ring is located on one of the end surface portions, the feed nodes being centrally located and coupled to the phasing ring at substantially diametrically opposed positions by respective feed connection conductors extending substantially radially of the cylindrical axis.

6. An antenna according to claim 1, wherein the phasing ring is circular, or meandered.

7. An antenna according to claim 1, wherein the substrate is a cylindrical body having a cylindrical side surface portion and proximal and distal end surface portions, and wherein the phasing ring is located on one of the end surface portions, the feed nodes being centrally located and coupled to the phasing ring by a reactive matching network housing a pair of generally diametrically opposite connections to the phasing ring.

8. An antenna according to claim 7, wherein the said connections comprise fan-shaped conductors each having an outer portion connected to the phasing ring along an arc subtending at least 45 degrees at the axis of the cylindrical body.

9. An antenna according to claim 1, wherein the radiating elements have first ends coupled to the phasing ring and second ends spaced from the phasing ring.

10. An antenna according to claim 9, wherein at least some of the second ends are open-circuit.

11. An antenna according to claim 9, having a second conductive ring on the substrate, which second ring links together at least some of the said second ends of the radiating elements.

12. An antenna according to claim 7, wherein the radiating elements comprise a plurality of helical radiating elements on the cylindrical side surface portion each having first ends coupled to the phasing ring and second ends spaced from the phasing ring, wherein the antenna further comprises a second conductive ring on or adjacent the other of the end surface portions of the cylindrical body, which second conductive ring is resonant at a second operating frequency of the antenna, and wherein the helical radiating elements comprise first radiating elements having open-circuit second ends spaced from the second ring and second, closed-circuit radiating elements, the second ends of which connect the second radiating elements to the second ring.

13. An antenna according to claim 12, wherein the electrical length of the first radiating elements is $(2m-1)\lambda_{g1}/4$ and the electrical length of the second radiating elements is $n\lambda_{g2}/2$, where m and n are non-zero positive integers and $\lambda_{g1}$ and $\lambda_{g2}$ are the guide wavelengths of the first and second operating frequencies of the antenna respectively.

14. An antenna according to claim 12, having a feeder structure comprising a transmission line section passing through the core from the proximal end surface portion to the distal end surface portion, the feed nodes forming the distal end of the transmission line section, wherein the reactive matching network comprises a two-pole network on the distal end surface portion.

15. A dielectrically loaded multifilar antenna for circularly polarised radiation having an operating frequency in excess of 200 MHz, wherein the antenna comprises: an electrically insulative core of a solid material that has a relative dielectric constant greater than 5 and occupies the major part of the interior volume defined by the core outer surface; a plurality of feed nodes; and an antenna element structure on or adjacent the core outer surface and comprising a plurality of elongate conductive antenna elements and, coupled between the elongate antenna elements and the feed nodes, a ring that is resonant at the operating frequency, the phasing ring having an inner periphery and an outer periphery, wherein the elongate antenna elements are coupled to the outer periphery of the phasing ring and the elongate antenna elements are extended from the resonant ring in a direction away from the feed nodes, wherein the feed nodes are coupled to the inner periphery of the phasing ring.

16. An antenna according to claim 15, wherein the said elongate conductive antenna elements have open-circuit ends.

17. An antenna according to claim 15, wherein the core has a central axis, and the core outer surface has first and second oppositely directed surface portions extending transversely with respect to the axis, and a side surface portion between the transversely extending surface portions, and wherein the feed nodes and the resonant ring are associated with the first transversely extending surface portion, and the said elongate conductive antenna elements extend over the side surface portion from the ring towards the second transversely extending surface portion.

18. An antenna according to claim 17, having two feed nodes connected to the ring at respective connection points that are oppositely located on the ring.

19. An antenna according to claim 15, having two feed nodes that are connected to the ring by respective inductive connecting links, the antenna further comprising a shunt capacitance coupled across the two feed nodes.

20. An antenna according to claim 17, wherein the core is cylindrical, the resonant ring comprises an annular conductive path on the said first transversely extending surface, and the elongate conductive antenna elements are helical and axially coextensive.

21. An antenna according to claim 17, wherein the core is cylindrical, the resonant ring comprises an annular conductive path on the said side surface portion adjacent the first transversely extending surface portion, and the elongate conductive antenna elements are helical and axially co-extensive.

22. An antenna according to claim 15, wherein the resonant ring includes at least one series-connected capacitance.

23. An antenna according to claim 16, wherein the elongate conductive antenna elements are at least one of quarter-wave elements or three-quarter-wave elements at said operating frequency.

24. An antenna according to claim 15, having a pair of feed nodes which constitute a balanced feed connection for the resonant ring.

25. A dielectrically loaded multifilar antenna for circularly polarised radiation having an operating frequency in excess of 200 MHz, wherein the antenna comprises: an electrically insulative core of a solid material that has a relative dielectric constant greater than 5 and occupies the major part of the interior volume defined by the core outer surface; a pair of feed nodes; and an antenna element structure on or adjacent the core outer surface and comprising a phasing ring connected to the feed nodes, the phasing ring having an inner periphery and an outer periphery and at least four elongate conductive elements coupled to the outer periphery of the phasing ring at respective spaced-apart points on the ring and the feed nodes are coupled to the inner periphery of the phasing ring.

26. An antenna according to claim 25, wherein the electrical length of each of the at least four elongate conductive elements is an odd number integer (1, 3, 5, . . . ) multiple of a quarter wavelength at the operating frequency.

27. An antenna assembly comprising an antenna according to claim 24 and a balun coupled to the feed nodes.

28. An antenna assembly comprising an antenna according to claim 18 and a differential amplifier having a differential input coupled to the feed nodes.

* * * * *